United States Patent [19]

Menegatto

[11] Patent Number: 4,662,165

[45] Date of Patent: May 5, 1987

[54] SPINDLE BRAKING DEVICE

[76] Inventor: Carlo Menegatto, Via E. Spreafico No. 3, 20052 Monza, Milano, Italy

[21] Appl. No.: 817,533

[22] Filed: Jan. 9, 1986

[30] Foreign Application Priority Data

May 14, 1985 [IT] Italy ..... 21804/85[U]

[51] Int. Cl.[4] ..... D01H 7/22; D01H 1/241

[52] U.S. Cl. ..... 57/88; 57/89; 57/105

[58] Field of Search ..... 57/88, 89, 104, 105

[56] References Cited

U.S. PATENT DOCUMENTS

| | | | |
|---|---|---|---|
| 2,433,987 | 1/1948 | Gleitz et al. | 57/89 |
| 2,648,948 | 8/1953 | Soussloff et al. | 57/89 |
| 3,141,288 | 7/1964 | Carroll | 57/88 |
| 3,251,180 | 5/1966 | Klein | 57/89 |
| 3,765,161 | 10/1973 | Kohler | 57/105 X |

FOREIGN PATENT DOCUMENTS 550108 5/1932 Fed. Rep. of Germany .

*Primary Examiner*—John Petrakes
*Attorney, Agent, or Firm*—Cushman, Darby & Cushman

[57] ABSTRACT

A braking device for spindles of textile machines, in which the spindle is caused to rotate by an endless drive belt; the braking device comprises a pivotable brake supporting member provided with a braking pad and a belt-disengaging idle roller. The brake support member is pivotable between a first operative position in which the braking pad and the roller are disengaged from the spindle and respectively from the drive belt, and a second operative position in which the idle roller disengages the belt from the spindle and the braking pad is pressed against the belt-pulley of the spindle; spring means act to maintain the brake support member in both operative positions.

7 Claims, 3 Drawing Figures

SPINDLE BRAKING DEVICE

DESCRIPTION OF THE INVENTION

This invention refers to a particular embodiment of a braking device for the spindles of textile machines.

In all spinning and twisting machines which make use of spindle which are made to rotate at high speed by means of tangential endless belts, there is the problem of braking and stopping each individual spindle, for example in order to remove the cop or torepair a break in the yarn.

This problem is becoming more and more significant due to the increasingly higher speeds of rotation of the spindles; even the slightest slipping of the drive belt on the spindle pulley, in fact, causes considerable overheating which is transmitted to the journal bearings, causing them damage, or to the belt itself which could weaken and snap, and lastly may also cause damage to the yarns whenever they consist of thermoplastic fibres.

For this reason, numerous types of manually-operated brakes for spindles have been designed and developed, which in addition to braking the spindle, also cause the disengagement of the drive belt. However, the known braking devices either have a complex structure or require complicated and sometimes rather dangerous manual operations for fitting and removing the individual spindles each time they have to be stopped.

A scope of this invention is to provide a braking device which can be fitted directly close to each spindle on textile machines, which is structurally simple and reliable and which can easily be operated without any danger whatsoever for the operator.

SUMMARY OF THE INVENTION

According to this invention, a spindle braking device is provided for textile machine, in which the spindle is caused to rotate by an endless drive belt frictionally engaging the belt pulley of the spindle, the braking device comprising a pivotable brake support member positioned close to the spindle, a braking member and a belt-disengaging idle roller on the brake support member, said brake support member being pivotable between a first operative position in which said braking member and said idle roller are disengaged from the belt pulley of the spindle and respectively from said drive belt, and a second operative position in which the idle roller is acting on the drive belt to disengage the same from said belt pulley, and in which the braking member is frictionally engaging the above mentioned belt pulley to brake the spindle; the device further comprising manually actuated means and spring means acting on the brake supporting member to pivot and to maintain the same in said first and second operative positions.

BRIEF DESCRIPTION OF THE DRAWINGS

The spindle braking device according to this invention will be illustrated in greater detail hereunder with reference to the figures of the accompanying drawings, in which.

DESCRIPTION OF THE INVENTION

Figure 1:
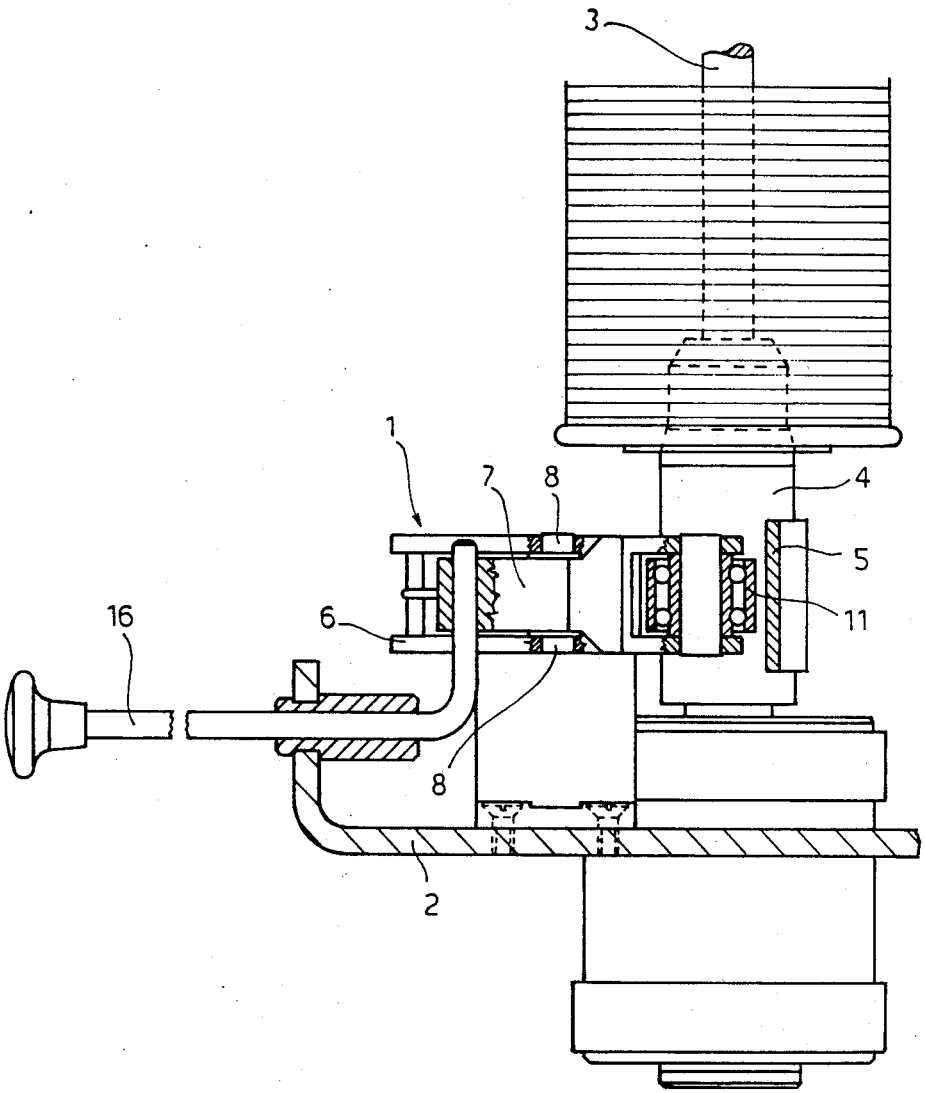
FIG. 1 shows a partially cutaway side view of a braking device provided in correspondence with a spindle.

FIG. 1 shows a braking device 1 fitted on the frame 2 of a textile machine, to the side of and close to a spindle 3 supported for rotation; the spindle 3 is provided with a belt pulley 4 frictionally actuated by a tangential drive belt 5 in order to rotate the spindle 3 at high speed.

The braking device 1, in the embodiment shown, comprises a base member 6, fastened to the frame 2, for example in the form of a boxed or U-shaped casing inside which is provided a brake support member in the form of a lever 7 pivoted to the base member 6 by means of two axially aligned pivot pins 8 which penetrate into corresponding holes in the base member 6.

The lever 7 comprises a first arm *7a* provided with a brake shoe 9 secured by means of an elastically yielding U-shaped arm 10 in the form of a spring steel band. The arm *7a* of the lever also supports an idle roller 11, arranged laterally to the brake 9, to disengage the belt 5 from the belt pulley 4, irrespective of the running direction of the belt itself, in the operative position of FIG. 3.

The other end *7b* of the lever is connected to a manually-operated actuating means or rod 16 which is made accessible to an operator.

Figure 2:
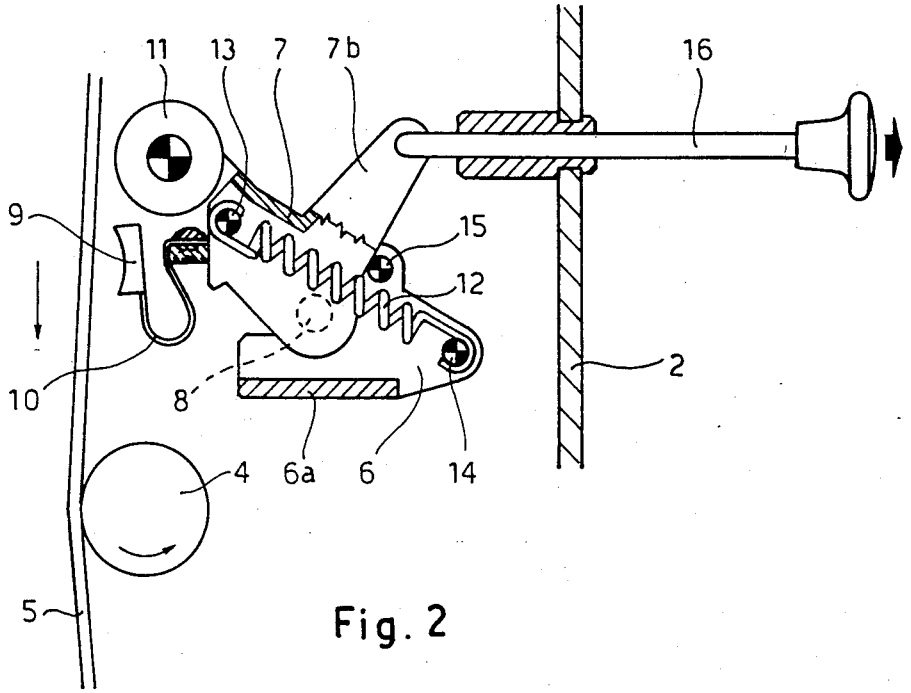
FIG. 2 shows a top view of the braking device in the disengaged condition of the spindle.
Figure 3:
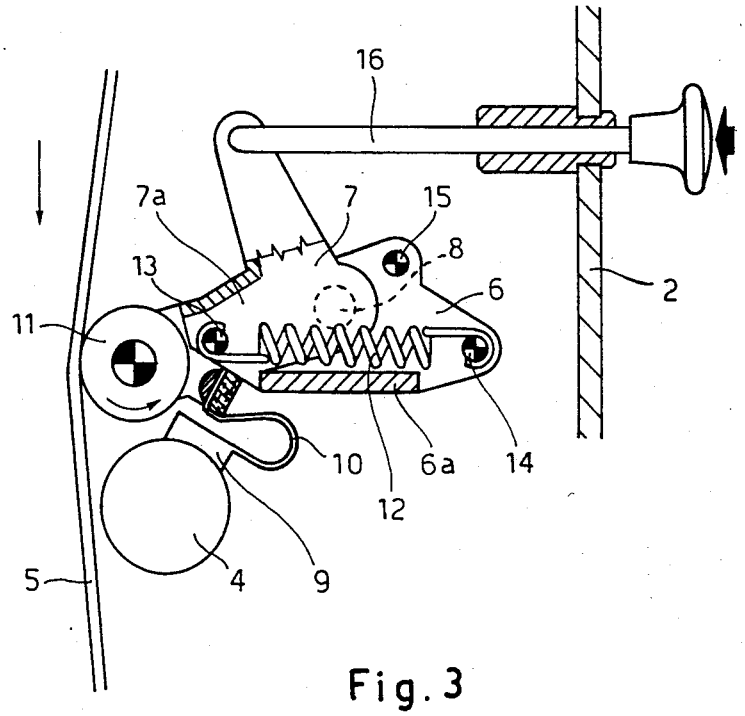
FIG. 3 shows a top view of the braking device in the braking condition of the spindle.

A return spring 12 is hooked onto a pin 13 near the end of the lever arm *7a* and to a pin 14 on the base member 6; the spring 12 acts to keep the lever 7 in each of two stable operative positions, shown in FIGS. 2 and 3, against stop means; in the first operative position of FIG. 2 the roller 11 and the brake shoe 9 are detached from the drive belt 5 and, respectively, the belt pulley 4, whilst in the second of the two aforesaid operative positions of FIG. 3, the roller 11 disengages the belt 5 from the belt pulley 4 and the brake shoe 9 frictionally comes into contact with the pulley 4 to brake the spindle. Consequently, the roller 11 and the brake shoe 9 on the lever 7 must be disposed in such a way that, when switching from the position of FIG. 2 to that of FIG. 3, first the roller 11 will act to disengage the belt 5 from the pulley 4 and then the brake 9 will be forced against the pulley 4 itself, and vice versa. In this way it is possible to achieve a quick braking effect, due to the snap action of the spring 12, thereby preventing the belt 5 from rubbing against the pulley 4 and becoming damaged.

As mentioned previously, the two operative positions of the lever 7 supporting the roller 11 and the brake 9 are maintained by the spring 12 pulling the lever 7 against two stop members; in the case shown, the first stop means, in the operative condition of FIG. 2, for the lever arm *7b*, is provided by a stop pin 15 on the base member 6, while in the second operative position of FIG. 3 the lever arm *7a* comes to rest against a respective stop means provided by a wall *6a* of the base member 6; in both positions, the longitudinal axis of the spring 12 lies to the side of the pivot pins 8 of the lever 6, so that the latter is held firmly in each of the operative positions.

What is claimed is:

1. A spindle braking device for applying braking force to belt driven spindles in textile machines, the braking device comprising a base member fixed to the textile machine and a brake support member pivotally mounted on said base member so as to be movable about a pivot axis between first and second positions, a braking member connected to said support member by an elastically yieldable support member, a belt-disengaging roller mounted to said brake support member, control means operatively connected to the brake support member to rotate the support member between the first position in which said braking member and said roller are disengaged from the spindle and drive belt respectively, and the second position in which said roller engages the drive belt to move it away from the spindle and the braking member is brought into engagement with the spindle; the device further including first and second stop means for stopping the movement of said brake support member, respectively, in said first and second positions, and spring means connected between said base member and said brake support member for respectively maintaining said brake support member against said first and second stop means in each of said first and second positions.

2. A spindle braking device as in claim 1, wherein said support member comprises a lever pivotally mounted to said base member, said lever having two arms wherein one arm supports said braking member and said belt-disengaging roller; the other arm being connected to said control means.

3. A spindle braking device as in claim 2 wherein said control means comprises a manually operable control rod.

4. A spindle braking device as in claim 2, wherein said lever is L-shaped.

5. A spindle braking device as in claim 1, in which the elastically yieldable support member is comprised of a leaf spring.

6. A spindle braking device as in claim 1, in which the elastically yieldable support member is comprised of a U-shaped spring steel band.

7. A spindle braking device as in claim 1, wherein said spring means is positioned between said base and brake support members so that it lies on one side of the pivot axis when the brake support member is in the first position and is moved on the opposite side of the pivot axis when the brake support member is moved into the second position.

* * * * *